US009857748B2

(12) United States Patent
Koga

(10) Patent No.: US 9,857,748 B2
(45) Date of Patent: Jan. 2, 2018

(54) SHEET SUPPORTING DEVICE

(71) Applicant: CANON KABUSHIKI KAISHA, Tokyo (JP)

(72) Inventor: Satoshi Koga, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/181,630

(22) Filed: Jun. 14, 2016

(65) Prior Publication Data

US 2017/0003635 A1 Jan. 5, 2017

(30) Foreign Application Priority Data

Jul. 2, 2015 (JP) ..... 2015-133226

(51) Int. Cl.

| | |
|---|---|
| ***B65H 1/04*** | (2006.01) |
| ***G03G 15/00*** | (2006.01) |
| ***B65H 1/08*** | (2006.01) |
| ***B65H 1/26*** | (2006.01) |

(52) U.S. Cl.

CPC ..... *G03G 15/6511* (2013.01); *B65H 1/04* (2013.01); *B65H 1/08* (2013.01); *B65H 1/266* (2013.01); *B65H 2220/03* (2013.01); *B65H 2405/31* (2013.01); *B65H 2511/15* (2013.01); *B65H 2511/152* (2013.01); *B65H 2551/20* (2013.01); *B65H 2553/61* (2013.01); *G03G 2215/00628* (2013.01)

(58) Field of Classification Search

CPC .... B65H 1/08; B65H 1/266; B65H 2511/152; B65H 2551/20

See application file for complete search history.

(56) References Cited

U.S. PATENT DOCUMENTS 6,869,071 B2 * 3/2005 Amamoto ..... B65H 1/12 271/145
7,758,042 B2 * 7/2010 Tomura ..... G03G 15/6502 271/147
7,784,781 B2 * 8/2010 Asada ..... B65H 1/266 271/145

(Continued)

FOREIGN PATENT DOCUMENTS

JP 2004-106983 A 4/2004

*Primary Examiner* — Jeremy R Severson
(74) *Attorney, Agent, or Firm* — Fitzpatrick, Cella, Harper & Scinto

(57) ABSTRACT

A sheet supporting device comprises a first supporting unit, a second supporting unit provided to the first supporting unit and drawable in a draw direction from an insert position, a supporting portion on which sheets are supported and provided ascendably/descendably in the first supporting unit, first and second turning portions configured to turn in linkage with an ascendance and descendance move of the supporting portion, an elevation portion, and an indicator. The elevation portion, whose one end is connected with the first turning portion and another end is connected with the second turning portion, is configured to form a link mechanism together with the first and second turning portions and the first supporting unit. The indicator is provided in the second supporting unit and indicates an amount of the sheets supported on the supporting portion by moving in response to an ascendance and descendance move of the elevation portion.

19 Claims, 9 Drawing Sheets

(56) References Cited

U.S. PATENT DOCUMENTS

| | | | | |
|---|---|---|---|---|
| 8,393,613 | B2 * | 3/2013 | Chen | B65H 7/02 271/145 |
| 8,684,347 | B2 * | 4/2014 | Ito | B65H 1/266 271/157 |
| 9,254,976 | B2 | 2/2016 | Koga | |
| 9,278,823 | B2 * | 3/2016 | Fujii | B65H 1/266 |

* cited by examiner

SHEET SUPPORTING DEVICE

BACKGROUND OF THE INVENTION

Field of the Invention

The present invention relates to a sheet supporting device configured to support a sheet and more specifically to a sheet supporting device including a sheet remaining amount indicator indicating a remaining amount of the supported sheet.

Description of the Related Art

Hitherto, an electro-photographic image forming apparatus is being widely applied as a copier, a printer, a plotter, a facsimile, a multifunction printer having a plurality of functions of these machines, and others. An image forming apparatus including a sheet supporting (stacking) device capable of stacking a large number of sheets is now common. Japanese Patent Application Laid-open No. 2004-106983 discloses a sheet supporting device including a sheet remaining amount indicator indicating a sheet remaining amount in linkage with a sheet stacking plate within the sheet supporting device so that a user can confirm the sheet remaining amount within the sheet supporting device.

This sheet supporting device includes a main frame body of a sheet cassette and an auxiliary frame body provided slidably within the main frame body and is configured to be able to extend/contract the sheet cassette by sliding the auxiliary frame body with respect to the main frame body corresponding to a size of a sheet to be stored. In the image forming apparatus including the sheet supporting device, a sheet feeding portion is disposed on a rear side of the apparatus body. Therefore, the sheet cassette is provided such that the main frame body is disposed on the rear side of the apparatus body and the auxiliary frame body is disposed drawably on a front side of the apparatus body.

In this sheet supporting device, the sheet remaining amount indicator includes a turning shaft extendible in a front-back direction, i.e., in a longitudinal direction thereof, across the main frame body and the auxiliary frame body, a detector portion provided at an end on the main frame body side of the turning shaft, and an indicator provided at an end on the auxiliary frame body side of the turning shaft. The detector portion is provided so as to project inside in a sheet width direction from the turning shaft and turns the turning shaft along with an elevation of the sheet stacking plate. The indicator includes an arm projecting toward outside widthwise from the turning shaft and an indicator piece movable up and down corresponding a rotation of the arm, and indicates a sheet remaining amount as the indicator piece moves to a level corresponding to a turning angle of the arm at a front surface of the auxiliary frame body when the arm is turned by the turning shaft. That is, the detector portion turns corresponding to the move of the sheet stacking plate, the turning shaft transmits the turn of the detector portion to the arm, and the turning movement of the arm is converted into a vertical movement of the indicator piece and is indicated as a sheet remaining amount. This configuration makes it possible for the user to readily perceive the indication of the sheet remaining amount even in a state in which the auxiliary frame body is drawn out of the main frame body because the turning shaft is extensible.

However, a length of a movable range of the indicator piece depends on a length of the arm in the sheet supporting device disclosed in Japanese Patent Application Laid-open No. 2004-106983. That is, it is necessary to prolong the arm if the movable range of the sheet remaining amount indicator is to be prolonged, and there is a possibility that the size of the sheet supporting device increases in the sheet width direction if the arm is prolonged.

SUMMARY OF THE INVENTION

The present invention aims at providing a sheet supporting device that enables to enlarge an indicating range of a sheet remaining amount indicator while including a sheet cassette extensible corresponding to a sheet size.

According to one aspect of the invention, a sheet supporting device includes a first supporting unit, a second supporting unit provided to the first supporting unit and drawable in a draw direction from an insert position, a supporting portion on which sheets are supported and provided ascendably/descendably in the first supporting unit, first and second turning portions configured to turn in linkage with an ascendance and descendance move of the supporting portion, an elevation portion whose one end is connected with the first turning portion and another end is connected with the second turning portion, the elevation portion configured to form a link mechanism together with the first and second turning portions and the first supporting unit, and an indicator provided in the second supporting unit and indicating an amount of the sheets supported on the supporting portion by moving in response to an ascendance and descendance move of the elevation portion.

Further features of the present invention will become apparent from the following description of exemplary embodiments with reference to the attached drawings.

DESCRIPTION OF THE EMBODIMENTS

<First Embodiment>

An image forming apparatus 1 of a first embodiment of the present invention will be described below in detail with reference to FIGS. 1A through 6B. As an example of the image forming apparatus 1, a printer adopting an electrophotographic image forming process will be described in the present embodiment. However, the present invention is not limited to the image forming apparatus 1 adopting the electro-photographic image forming process and may be an image forming apparatus of another type such as a printer adopting an ink-jet image forming process. It is noted that in the present embodiment, a front side facing the image forming apparatus 1 will be denoted as a front direction F, a rear side (back side) as a back direction B, a left side as a left direction L, a right side as a right direction R, an upper side as an upper direction U, a lower side as a downward direction D, and a left-right direction as a width direction W, respectively, as indicated in the respective drawings.

Figure 1A:
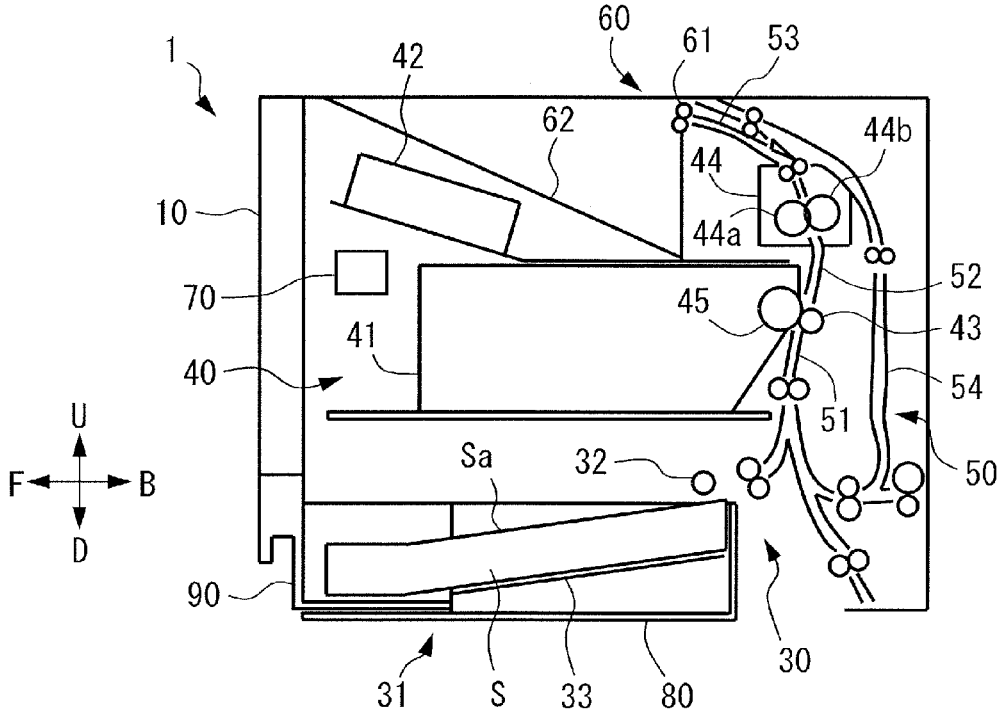
FIG. 1A is a section view schematically illustrating an image forming apparatus of a first embodiment in a state in which an auxiliary frame body is inserted into a main frame body.
Figure 1B:
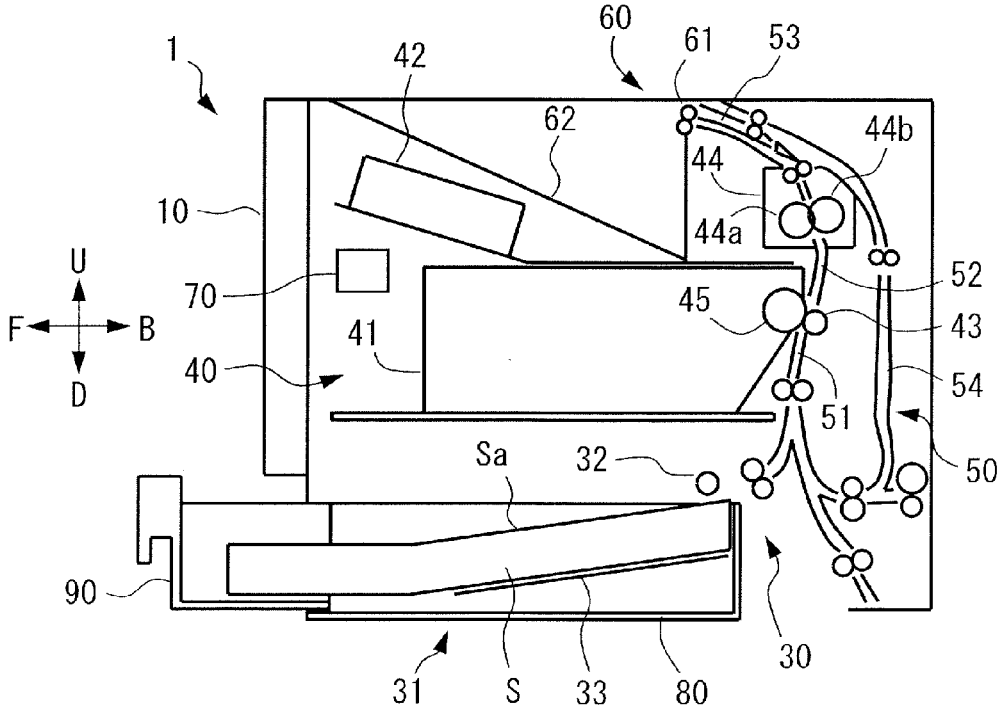
FIG. 1B is a section view schematically illustrating the image forming apparatus of the first embodiment in a state in which the auxiliary frame body is drawn out of the main frame body.

As illustrated in FIGS. 1A and 1B, the image forming apparatus 1 of the present embodiment includes a body of the image forming apparatus (referred to as an 'apparatus body' hereinafter) 10. The apparatus body 10 includes a sheet feeding portion 30, an image forming portion 40, a sheet conveyance portion 50, a sheet discharge portion 60, and a control portion 70. It is noted that the sheet S, i.e., a recording medium, is what a toner image is formed thereon. Specifically, the sheet S includes a plain sheet, a synthetic resin sheet as a substitute of the plain sheet, a thick sheet, an overhead projector sheet, or the like.

The sheet feeding portion 30 is disposed at a lower part of the apparatus body 10 and includes a sheet cassette (sheet supporting device) 31 stacking (supporting) and storing the sheet S and a feed roller 32 feeding the sheet S to the image forming portion 40. Details of the sheet cassette 31 will be described later.

The image forming portion 40 includes a process cartridge 41, a laser scanner 42, a transfer roller 43, and a fixing portion 44 to form an image.

The process cartridge 41 is constructed by integrating a photosensitive drum 45 and processors acting on the photosensitive drum 45 as a cartridge and is attachable to/detachable from the apparatus body 10. The laser scanner 42 irradiates the photosensitive drum 45 with a laser beam corresponding to image information to form an electrostatic latent image on a surface of the photosensitive drum 45. The electrostatic latent image is then developed as a toner image by a developing portion (not illustrated) within the process cartridge 41. The toner image is transferred onto the sheet S fed to the image forming portion 40 as an unfixed image by applying a bias to the transfer roller 43. The sheet S on which the toner image has been transferred is then fed to the fixing portion 44.

The fixing portion 44 includes a fixing roller 44*a* and a pressure roller 44*b*. The toner image transferred onto the sheet S is pressed and heated to be fixed onto the sheet S while being nipped and conveyed between a fixing nip formed by the fixing roller 44*a* and the pressure roller 44*b*.

The sheet conveyance portion 50 includes a pre-transfer conveyance path 51, a pre-fixing conveyance path 52, a discharge path 53, and a re-conveyance path 54. The sheet conveyance portion 50 conveys the sheet S fed from the sheet feeding portion 30 to the sheet discharge portion 60 through the image forming portion 40.

The sheet discharge portion 60 includes a discharge roller pair 61 disposed downstream of the discharge path 53 and a discharge tray 62 formed at an upper part of the apparatus body 10. The sheet S conveyed from the discharge path 53 is conveyed through a nip portion of the discharge roller pair 61 and is discharged to and stacked on the discharge tray 62.

The control portion 70 is composed of a computer and includes a CPU, a ROM storing programs controlling the respective components, a RAM temporarily storing data, and an input/output circuit inputting from/outputting to an outside.

Next, an image forming operation of the image forming apparatus 1 constructed as described above will be described.

In response to a start of the image forming operation, the photosensitive drum 45 rotates at first so that the surface thereof is electrified. Then, the laser scanner 42 illuminates the photosensitive drum 45 with the laser beam based on the image information to form an electrostatic latent image on the surface of the photosensitive drum 45. The electrostatic latent image is then developed by toner and is visualized as a toner image.

Meanwhile, in parallel with such toner image forming operation, the feed roller 32 rotates and feeds, while separating, an uppermost sheet Sa within the sheet cassette 31. Then, while synchronizing with the toner image on the photosensitive drum 45, the sheet S is conveyed to a nip portion between the photosensitive drum 45 and the transfer roller 43 through the pre-transfer conveyance path 51. Then, the toner image is transferred from the photosensitive drum 45 onto the sheet S. Subsequently, the sheet S is conveyed to the fixing portion 44, and the unfixed toner image is heated and pressed here to be fixed on the surface of the sheet S. Then, the sheet S is discharged by the discharge roller pair 61 to be stacked on the discharge tray 62.

Next, a configuration of the sheet cassette 31 will be described in detail with reference to FIGS. 1A through 4B. The sheet cassette 31 includes a main frame body (first supporting unit) 80 provided attachably to/detachably from the apparatus body 10 and an auxiliary frame body (second supporting unit) 90 provided movably in/out of the main frame body 80 in the front-back direction. That is, the sheet cassette 31 is configured to be able to extend/contract an entire size thereof by moving the auxiliary frame body 90 in/out of the main frame body 80 in the front-back direction corresponding to a size of a sheet to be stored.

Figure 2A:
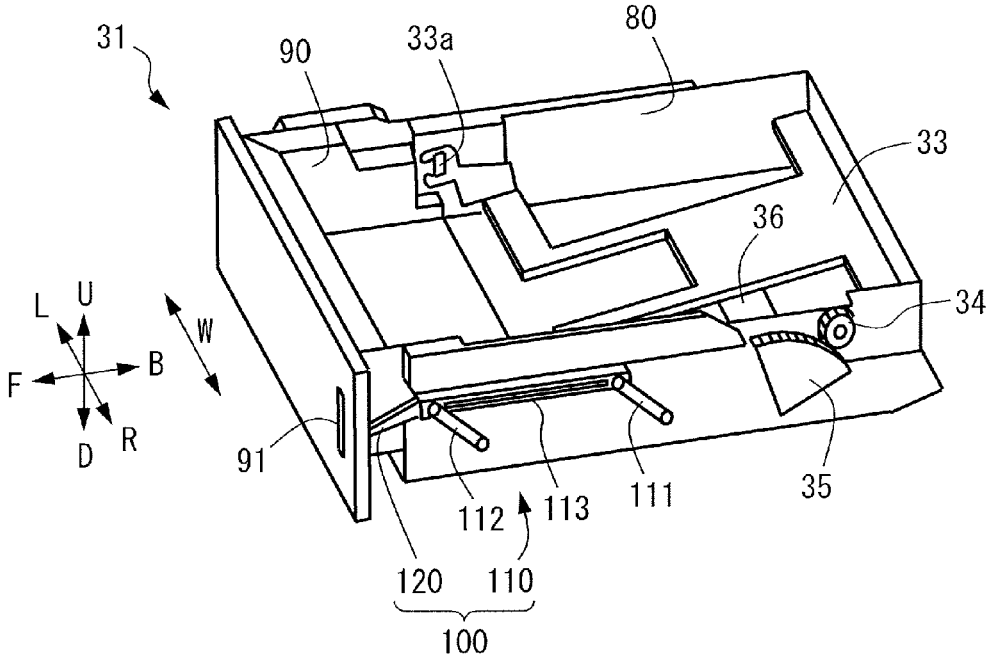
FIG. 2A is a perspective view schematically illustrating a sheet cassette in the state in which the auxiliary frame body is inserted into the main frame body of the image forming apparatus of the first embodiment.
Figure 2B:
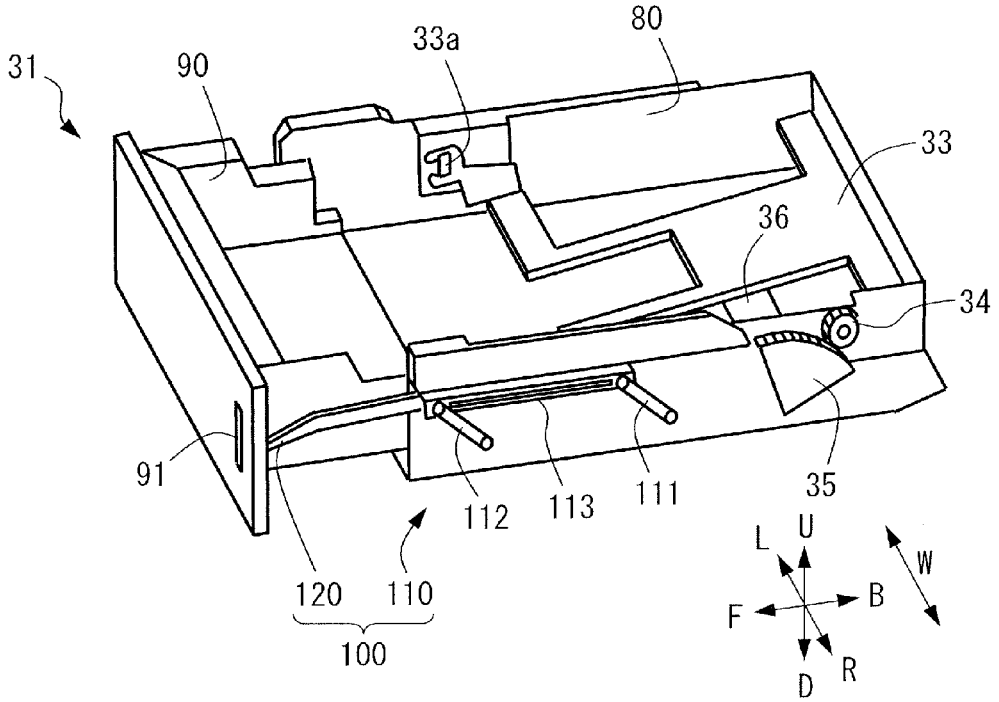
FIG. 2B is a perspective view schematically illustrating the sheet cassette in the state in which the auxiliary frame body is drawn out of the main frame body of the image forming apparatus of the first embodiment.

In the image forming apparatus 1 of the present embodiment, the feed roller 32 is disposed on a back side of the apparatus body 10. Therefore, the sheet cassette 31 is configured such that the main frame body 80 is disposed on the back side of the apparatus body 10 and the auxiliary frame body 90 is disposed on the front side of the apparatus body 10 so as to be drawable from the main frame body 80. It is noted that as illustrated in FIGS. 2A and 2B, an indicator window 91, i.e., a through hole, exposing an indicator end 120*b* described later, is provided on a front side part of the auxiliary frame body 90. That is, the auxiliary frame body 90 has the indicator window 91 exposing the indicator end 120*b* on the side of the draw direction.

As illustrated in FIG. 1A, a front surface of the auxiliary frame body 90 is located at a position (insert position) in flush with a front wall surface of the apparatus body 10 in a state in which the auxiliary frame body 90 is inserted into the main frame body 80. Still further, as illustrated in FIG. 1B, the front surface of the auxiliary frame body 90 is located at a position (draw-out position) where the front surface of the auxiliary frame body 90 projects in the front direction F out of the apparatus body 10 in a state in which the auxiliary frame body 90 is drawn most out of the main frame body 80. At this time, it is possible to store a sheet SL whose size is larger than the sheet S which can be stored in the sheet cassette 31 in the state in which the auxiliary frame body 90 is inserted into the main frame body 80. That is, the auxiliary frame body 90 is provided so as to be drawable from the main frame body 80 from the insert position.

As illustrated in FIGS. 2A and 2B, the sheet cassette 31 is provided with a sheet stacking plate (supporting portion) 33. The sheet stacking plate 33 is supported by the main frame body 80 turnably centering on a turning center 33*a*. The sheet S is stacked (supported) on the sheet stacking plate 33 within the sheet cassette 31. That is, the sheet stacking plate 33 on which the sheet S is stacked is provided ascendably/descendably within the main frame body 80. The sheet cassette 31 also includes, on a right side thereof for example, a drive transmission gear 34 transmitting a drive from a driving source not illustrated, a fan gear 35 receiving the drive from the drive transmission gear 34, and a swing arm 36 moving integrally with the fan gear 35. It is noted that the driving source, the drive transmission gear 34, the fan gear 35, and the swing arm 36 compose a lift portion lifting the sheet stacking plate 33.

The swing arm 36 is provided swingably centering on a rotation axis of the fan gear 35. The swing arm 36 is configured to be able to lift the sheet stacking plate 33 by slidingly pushing up a bottom surface of the sheet stacking plate 33 by an upper front edge thereof (see FIGS. 7A and 7B). That is, when the drive is transmitted from the driving source and the swing arm 36 turns, the sheet stacking plate 33 is pushed up and is lifted, or when the swing arm 36 turns in an opposite direction, the sheet stacking plate 33 comes down by its own weight. The sheet cassette 31 is also provided with a sensor detecting that the uppermost sheet Sa of a sheet bundle stored within the sheet cassette 31 has come into contact with the feed roller 32, and the control portion 70 stops the driving source and the sheet stacking plate 33 in response to a detection of the case by the sensor. Accordingly, the fewer the number of sheets S within the sheet cassette 31, the higher the sheet stacking plate 33 rises.

The sheet cassette 31 is provided also with a sheet remaining amount indicator 100 on the right side of the sheet cassette 31 for example. The sheet remaining amount indicator 100 includes a sheet remaining amount detecting portion (moving portion) 110 held by the main frame body 80 and a sheet remaining amount indicating lever (indicator) 120 held by the auxiliary frame body 90.

The sheet remaining amount detecting portion 110 includes a first link member (first turning portion) 111, a second link member (second turning portion) 112, and a connecting member (elevation portion) 113 connected to the two link members 111 and 112. The first link member 111 is disposed on the back side of the second link member 112.

Figure 3A:
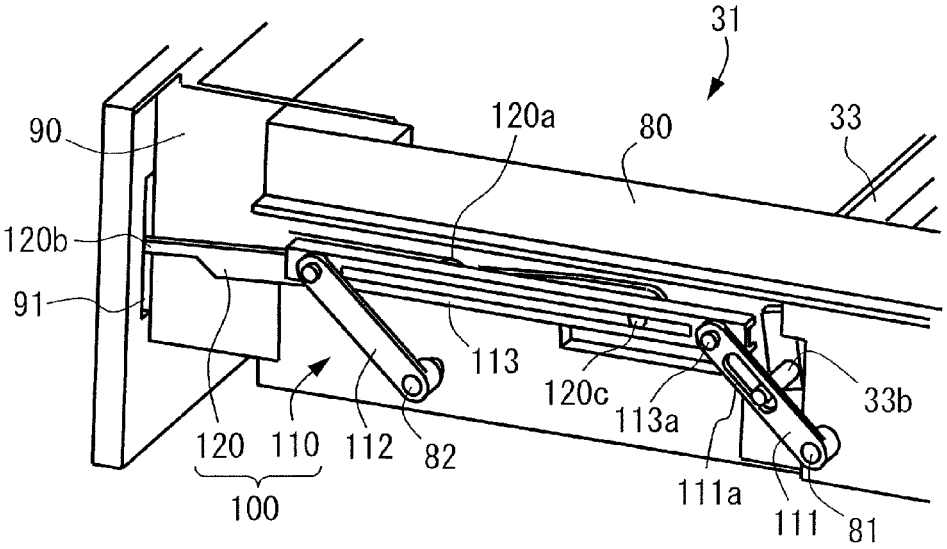
FIG. 3A is a perspective view schematically illustrating a sheet remaining amount indicator of the sheet cassette of the image forming apparatus of the first embodiment.
Figure 3B:
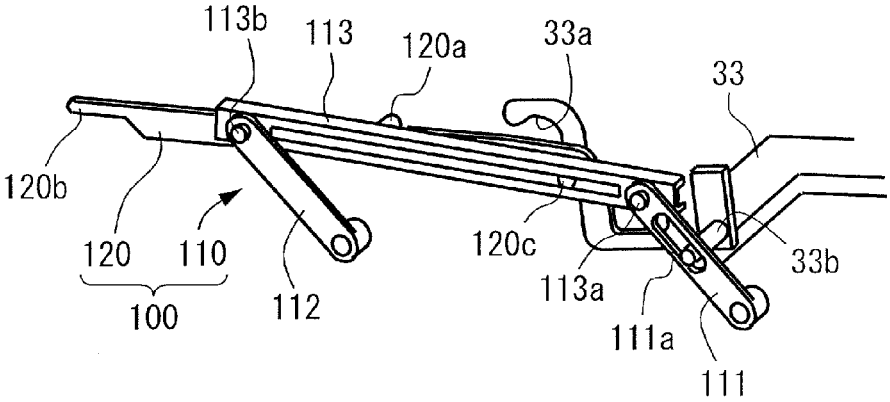
FIG. 3B is a perspective view schematically illustrating the sheet remaining amount indicator of the sheet cassette of the image forming apparatus of the first embodiment in a state in which the main frame body and the auxiliary frame body are taken away.
Figure 3C:
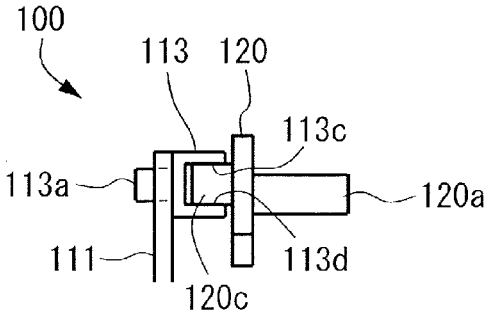
FIG. 3C is a back view illustrating the sheet remaining amount indicator in FIG. 3B.

As illustrated in FIGS. 3A through 3C, the first link member 111 is turnably supported by a shaft 81 with respect to the main frame body 80 at one end thereof and is turnably supported by the connecting member 113 by a shaft 113*a* at another end thereof. Still further, along a longitudinal direction thereof, the first link member 111 has an engaged hole 111*a* slidably engaging with the shaft 33*b* projecting in the width direction W from the sheet stacking plate 33. Thereby, the first link member 111 turns in response to an ascendance and descendance move of the sheet stacking plate 33. That is, the lift portion moves the connecting member 113 through the first link member 111 by ascending/descending the sheet stacking plate 33.

The second link member 112 is turnably supported by the main frame body 80 by a shaft 82 at one end thereof and is turnably supported by the connecting member 113 by a shaft 113*b* at another end thereof. That is, the sheet remaining amount detecting portion 110 includes the first and second link members 111 and 112 turnably linked respectively with the connecting member 113 and the main frame body 80. Thus, the second link member 112 turns in response to the ascendance and descendance move of the sheet stacking plate 33.

Figure 4A:
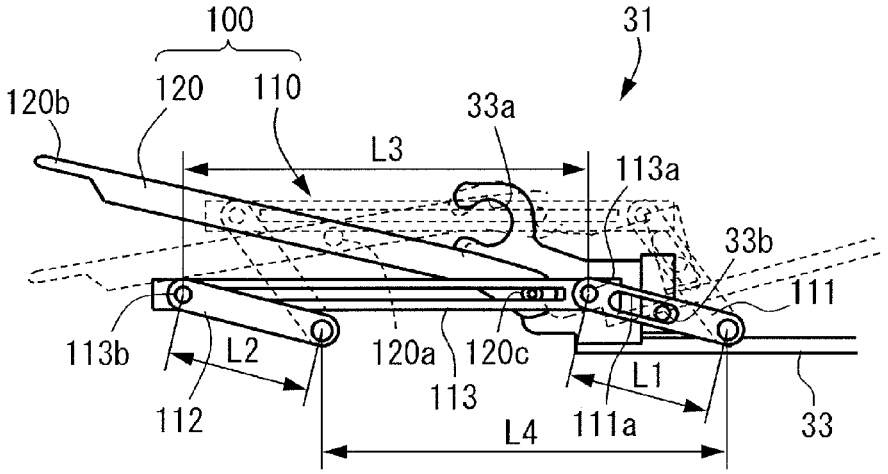
FIG. 4A is a side view schematically illustrating the sheet remaining amount indicator of the sheet cassette of the image forming apparatus of the first embodiment in the state in which the auxiliary frame body is inserted into the main frame body.
Figure 4B:
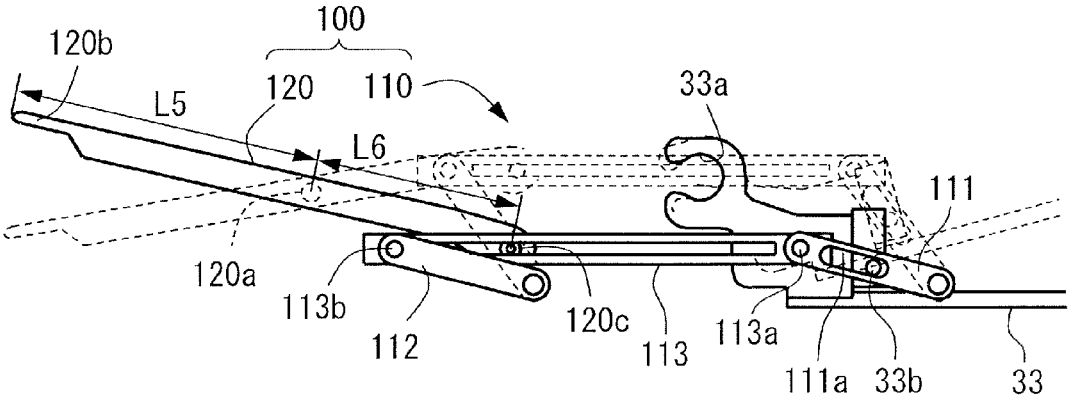
FIG. 4B is a side view schematically illustrating the sheet remaining amount indicator of the sheet cassette of the image forming apparatus of the first embodiment in the state in which the auxiliary frame body is drawn out of the main frame body.

Here, as illustrated in FIGS. 4A and 4B, a length of the first link member 111 (a length between the shaft 81 connected to the main frame body 80 and the shaft 113*a* connected to the connecting member 113) will be denoted as L1. Still further, a length of the second link member 112 (a length between the shaft 82 connected to the main frame body 80 and the shaft 113*b* connected to the connecting member 113) will be denoted as L2. Here, sizes of the respective components are set such that L1=L2.

The connecting member 113 is connected to the first and second link members 111 and 112 respectively by the two shafts 113*a* and 113*b*. That is, one end of the connecting member 113 is connected with the first link member 111 and another end thereof is connected with the second link member 112. Here, sizes of the respective members are set such that a length L3 between the two shafts 113*a* and 113*b* is equalized with a length L4 between the two shafts 81 and 82 provided on the main frame body 80. That is, the connecting member 113, the first and second link members 111 and 112, and the main frame body 80 compose a parallel link mechanism. That is, the sheet remaining amount detecting portion 110 includes the connecting member 113 provided on the main frame body 80 and kept approximately in a horizontal state (in parallel with the draw direction) and is provided movably in a vertical direction in a state in which the connecting member 113 is kept approximately in the horizontal state corresponding to the ascendance and descendance move of the sheet stacking plate 33.

In FIGS. 4A and 4B, solid lines represent a state in which a large number of sheets is stacked on the sheet stacking plate 33 and the indicator end 120*b* is located at an upper position, and broken lines represent a state in which a few sheets is stacked on the sheet stacking plate 33 and the indicator end 120*b* is located at a lower position.

As illustrated in FIG. 3C, the connecting member 113 includes two sliding faces (engaged portion, concave portion) 113*c* and 113*d* facing with each other along a longitudinal direction thereof. Positions of the respective shafts 81, 82, 113*a*, and 113*b* are determined such that these two sliding faces 113*c* and 113*d* are kept approximately in a horizontal state (in parallel with a horizontal surface) regardless of the turn of the two link members 111 and 112. An engage portion (convex portion) 120*c* described later of the sheet remaining amount indicator lever 120 is interposed slidably in the front-back direction between the two sliding faces 113*c* and 113*d*. That is, the connecting member 113 is kept approximately in the horizontal state, permits the engage portion 120*c* to move in the horizontal direction, and moves together integrally with the engage portion 120*c* approximately in the vertical direction.

Meanwhile, as illustrated in FIGS. 3A through 3C, the sheet remaining amount indicator lever 120 is turnably supported by the auxiliary frame body 90 by a shaft (rotation shaft) 120*a*. The sheet remaining amount indicator lever 120 includes the indicator end 120*b* exposed out of the indicator window 91 of the auxiliary frame body 90 at a front end thereof. Therefore, the user is able to confirm a remaining amount of the sheet S stored in the sheet cassette 31 by visually confirming a position (height) of the indicator end 120*b* in the indicator window 91. It is noted that the indicator end 120*b* is formed straightly in the front-back direction.

Still further, the sheet remaining amount indicator lever 120 includes the engage portion 120*c* engaging with the connecting member 113 at a rear end thereof. The engage portion 120*c* is interposed slidably in the front-back direction between the two sliding faces 113*c* and 113*d* of the connecting member 113. That is, the engage portion 120*c* is movable approximately in the horizontal direction with respect to the connecting member 113 and is movable integrally with the connecting member 113 in the vertical direction. It is noted that the engage portion 120*c* is not always necessary to be interposed between the two sliding faces 113*c* and 113*d* and may be configured to be in contact with either one of the two sliding faces 113*c* and 113*d* of the connecting member 113 by an urging force caused by the gravity or an elastic member for example.

The connecting member 113 is provided with a concave portion concaved in section by the two sliding faces 113*c* and 113*d*. Meanwhile, the engage portion 120*c* forms a convex portion projecting from the sheet remaining amount indicator lever 120. That is, the connecting member 113 is provided with the concave portion and the sheet remaining amount indicator lever 120 is provided with the convex portion engaged with the concave portion. However, the relationship between the concave and convex portions is not limited to such configuration, and the connecting member 113 and the sheet remaining amount indicator lever 120 may be configured such that the concave portion is provided at either one of the connecting member 113 and the sheet remaining amount indicator lever 120 and the convex portion engaging with the concave portion is provided at the other one of the connecting member 113 and the sheet remaining amount indicator lever 120.

Thus, the sheet remaining amount indicator lever 120 is provided on the auxiliary frame body 90 and indicates the remaining amount of the sheet S stacked on the sheet stacking plate 33 by moving in response to the ascendance and descendance move of the connecting member 113. The sheet remaining amount indicator lever 120 is also movable in response to the move of the sheet remaining amount detecting portion 110 in the states in which the auxiliary frame body 90 is located at the insert position and in which the auxiliary frame body 90 is drawn out of the insert position, respectively. That is, the sheet remaining amount indicator lever 120 is movable in response to the move of the sheet remaining amount detecting portion 110 in the state in which the auxiliary frame body 90 is located at a position between the insert position and the draw-out position. In other words, the sheet remaining amount indicator lever 120 is movable in response to the move of the sheet remaining amount detecting portion 110 in the state in which the auxiliary frame body 90 is drawn out of the main frame body 80.

Still further, because a ratio between a length L5 between the shaft 120*a* and the indicator end 120*b* and a length L6 between the shaft 120*a* and the engage portion 120*c* of the sheet remaining amount indicator lever 120 can be set arbitrarily, it is possible to adequately set a length of a movable range of the indicator end 120*b* by this ratio (see FIG. 4B). Due to that, a size in a height direction of the indicator window 91 can be arbitrarily determined without affecting a size in the width direction W of the apparatus body 10.

Next, an operation of the sheet cassette 31 of the image forming apparatus 1 of the present embodiment will be described.

When the sheet cassette 31 storing the sheet S is attached to the apparatus body 10 in the state in which the auxiliary frame body 90 is inserted, the driving source not illustrated is driven and the sheet stacking plate 33 turns centering on the turning center 33*a*. At this time, because the sheet stacking plate 33 turns until when the uppermost sheet Sa abuts against the feed roller 32, the fewer the number of sheets S stored in the sheet cassette 31, the higher the sheet stacking plate 33 turns upward.

When the sheet stacking plate 33 rises, the first link member 111 engaging with the shaft 33*b* of the sheet stacking plate 33 turns such that the shaft 113*a* side thereof rises. Here, the connecting member 113, the first and second link members 111 and 112, and the main frame body 80 composes the parallel link mechanism described above. Therefore, the first and second link members 111 and 112 turn by equal angles. This arrangement makes it possible for the connecting member 113 held by the two link members 111 and 112 to move along a vertical surface including the front-back direction and the vertical direction while keeping the two facing sliding faces 113*c* and 113*d* approximately in the horizontal state.

Along with the rise of the connecting member 113, the engage portion 120*c* of the sheet remaining amount indicator lever 120 turns upward, and the indicator end 120*b* of the sheet remaining amount indicator lever 120 turns downward. Therefore, the indicator end 120*b* moves downward within the indicator window 91, indicating the user that the sheet S within the sheet cassette 31 is decreasing.

Next, a case when the auxiliary frame body 90 is drawn out of the main frame body 80 to store a large size sheet S will be described. In this case, in the state in which the auxiliary frame body 90 has been drawn out of the main frame body 80, the sheet remaining amount indicator lever 120 is drawn out in the front direction of the apparatus body 10 together with the auxiliary frame body 90. At this time, the engage portion 120*c* of the sheet remaining amount indicator lever 120 is drawn out along the two facing sliding faces 113*c* and 113*d* of the connecting member 113. That is, when the auxiliary frame body 90 is drawn out of the main frame body 80, the engage portion 120*c* moves along the connecting member 113. Because the connecting member 113 ascends/descends while keeping its approximately horizontal state corresponding to the sheet remaining amount, the sheet remaining amount indicator lever 120 can accurately indicate the remaining amount of the sheet S within the sheet cassette 31 regardless of the extension/contraction of the auxiliary frame body 90.

As described above, according to the sheet cassette 31 of the present embodiment, the connecting member 113 ascends/descends in response to the ascendance and descendance move of the sheet stacking plate 33, and the engage portion 120*c* of the sheet remaining amount indicator lever 120 can be interlocked with the connecting member 113 being ascended/descended regardless of the position of the auxiliary frame body 90. Due to that, the indicator end 120*b* of the sheet remaining amount indicator lever 120 can accurately indicate the sheet remaining amount. Still further, because the sheet remaining amount indicator lever 120 moves approximately in the horizontal and vertical directions, it is not necessary to consider a move of the sheet remaining amount indicator lever 120 in the width direction W of the sheet S. This arrangement makes it possible to increase the indicating range of the sheet remaining amount indicator 100, i.e., the height of the indicator window 91, without increasing the size of the apparatus body 10 while having the sheet cassette 31 extendable corresponding to a sheet size.

Still further, according to the sheet cassette 31 of the present embodiment, it is possible to arbitrarily set the ratio between the length L5 between the shaft 120*a* and the indicator end 120*b* and the length L6 between the shaft 120*a* and the engage portion 120*c* of the sheet remaining amount indicator lever 120. Due to that, because the length of the movable range of the indicator end 120*b* can be adequately set by this ratio, it is possible to arbitrarily determine the size in the height direction of the indicator window 91 without affecting the size in the width direction W of the apparatus body 10.

Figure 5:
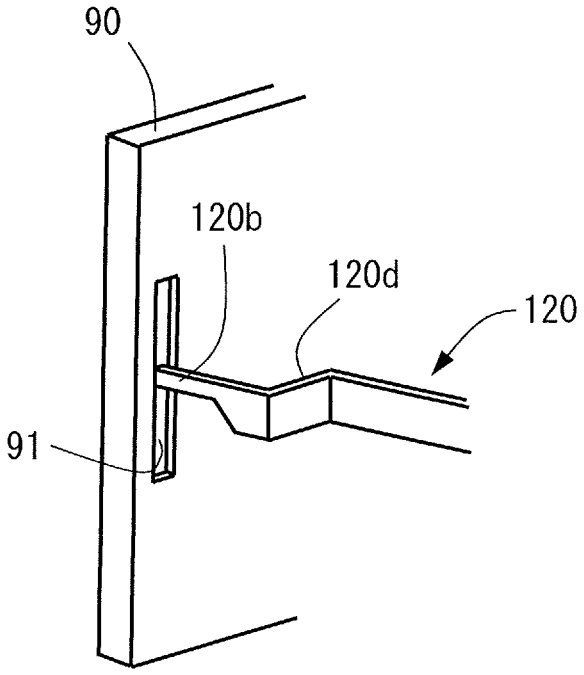
FIG. 5 is a perspective view schematically illustrating a modified example of the sheet cassette of the image forming apparatus of the first embodiment.

While the case where the indicator end 120*b* is straight in the front-back direction has been described above in the present embodiment, the present invention is not limited to such configuration. For instance, as illustrated in FIG. 5, the indicator end 120*b* may be configured to have a crank portion 120*d* bent like a crank. In this case, it is possible to change the position in the width direction W of the indicator window 91 in the auxiliary frame body 90 arbitrarily corresponding to a design of the apparatus without adding any component.

Figure 6A:
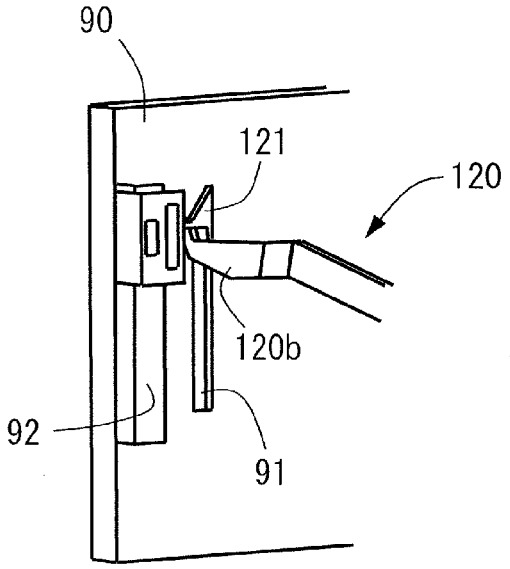
FIG. 6A is a back perspective view schematically illustrating another modified example of the sheet cassette of the image forming apparatus of the first embodiment.
Figure 6B:
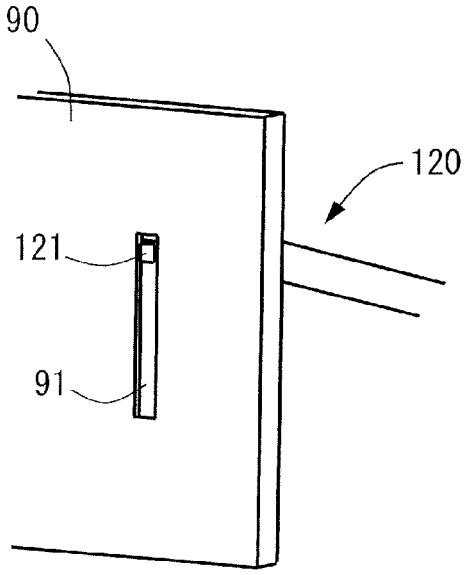
FIG. 6B is a front perspective view schematically illustrating the other modified example of the sheet cassette of the image forming apparatus of the first embodiment.

Still further, while the case where the indicator end (lever) 120*b* is directly exposed out of the indicator window 91 has been described in the present embodiment described above, the present invention is not limited to such configuration. For instance, as illustrated in FIGS. 6A and 6B, the indicator end 120*b* may be configured to have an indicator piece 121 exposed out of the indicator window 91. In this case, a rail portion 92 running along the vertical direction is provided on the auxiliary frame body 90. Then, the indicator piece 121 is attached ascendably/descendably to the rail portion 92 and a part of the indicator piece 121 is exposed out of the indicator window 91. Still further, a bottom face of the indicator piece 121 is supported from underneath by a front end part of the indicator end 120*b* of the sheet remaining amount indicator lever 120. This arrangement makes it possible to improve visibility of the user as compared to the case of directly visually confirming the indicator end 120*b* moving a circular arc orbit because the indicator piece 121 moves straightly along the rail portion 92 and does not come in and out in the front-back direction in the indicator window 91. Still further, while the case where the sheet remaining amount detecting portion 110 comprises the quardric link parallel link mechanism has been described in the present embodiment described above, the present invention is not limited to such configuration. For instance, the sheet remaining amount detecting portion 110 may be configured to comprise a parallel link mechanism except a quardric link mechanism.

<Second Embodiment>

A second embodiment of the present invention will be described with reference to FIGS. 7A and 7B. A configuration of the present embodiment is different from that of the first embodiment in that the connecting member 113 is supported by a fan gear 135 and the second link member 112. The configurations of the both embodiments are the same other than that, so that the same or corresponding components will be denoted by the same reference numerals and their description will be omitted here.

Figure 7A:
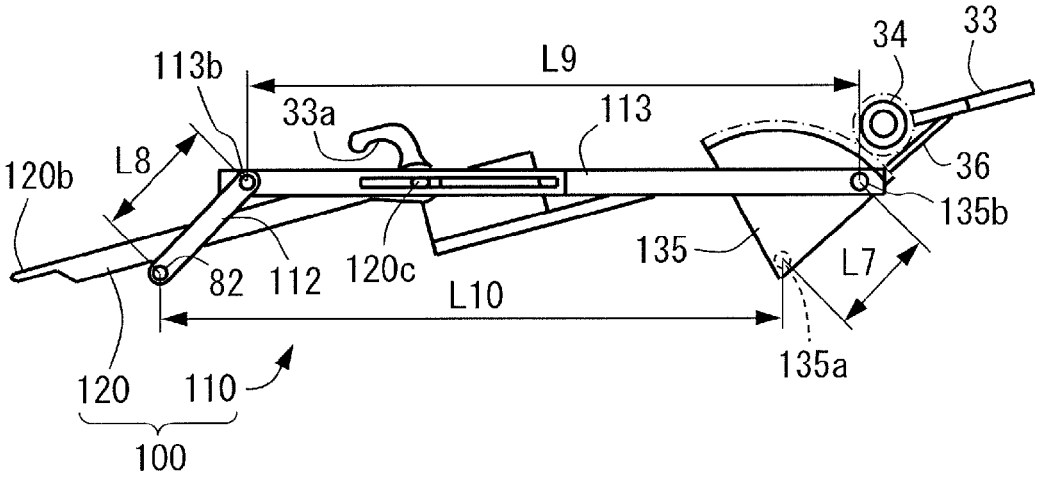
FIG. 7A is a side view schematically illustrating a sheet remaining amount indicator of a sheet cassette of an image forming apparatus of a second embodiment in a state in which there are a few sheets.
Figure 7B:
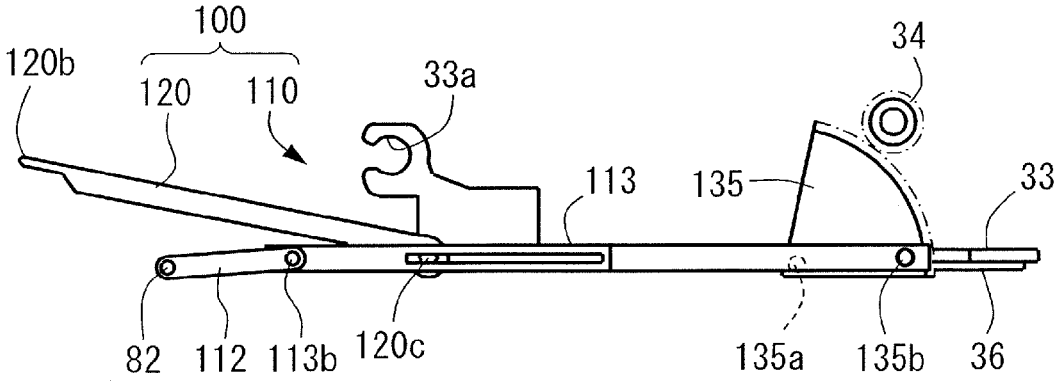
FIG. 7B is a side view schematically illustrating the sheet remaining amount indicator of the sheet cassette of the image forming apparatus of the second embodiment in a state in which there are many sheets.

As illustrated in FIGS. 7A and 7B, the sheet cassette 31 of the present embodiment includes, on a right side of the sheet cassette 31 for example, the drive transmission gear 34 transmitting a drive from the driving source not illustrated, the fan gear 135 receiving the drive from the drive transmission gear 34, and a swing arm 36 moving integrally with the fan gear 135. The fan gear 135 is supported by the main frame body 80 turnably centering on a shaft 135*a*. It is noted that a lift portion lifting the sheet stacking plate 33 is composed of these driving source, the drive transmission gear 34, the fan gear 135, and the swing arm 36.

The sheet remaining amount detecting portion 110 includes the fan gear (first turning portion) 135, the second link member 112, and the connecting member 113 connected to these members. The second link member 112 is disposed on the front side of the fan gear 135.

The fan gear 135 is supported by the connecting member 113 turnably by a shaft 135*b*. Thereby, when the fan gear 135 rotates, the sheet stacking plate 33 ascends/descends and the connecting member 113 moves in the same time. Here, a length of the fan gear 135 (a length between the shaft 135*a* and the shaft 135*b*) will be denoted by L7. Still further, a length of the second link member 112 (a length between the shaft 82 connected to the main frame body 80 and the shaft 113*b* connected to the connecting member 113) will be denoted by L8. In this case, sizes of the respective members are set such that L7=L8. Still further, sizes of the respective members are set such that a length L9 between the two shafts 135*b* and 113*b* is equal with a length L10 between the two shafts 135*a* and 82. That is, the connecting member 113, the fan gear 135, the second link member 112, and the main frame body 80 compose a parallel link mechanism. That is, the sheet remaining amount detecting portion 110 is provided on the main frame body 80, includes the connecting member 113, and is movable in the vertical direction while keeping the connecting member 113 approximately in the horizontal state in response to the ascendance and descendance move of the sheet stacking plate 33.

According to the sheet cassette 31 of the present embodiment, the sheet stacking plate 33 turns centering on the turning center 33*a* if the driving source not illustrated is driven when the sheet cassette 31 storing the sheet S in the state in which the auxiliary frame body 90 is inserted is attached to the apparatus body 10. In the same time when the sheet stacking plate 33 rises, the connecting member 113 is moved through the fan gear 135. The connecting member 113 moves along a vertical surface containing the front-back direction and the vertical direction while approximately keeping its horizontal state.

Accordingly, the connecting member 113 ascends/descends in response to the ascendance and descendance move of the sheet stacking plate 33 and the engage portion 120*c* of the sheet remaining amount indicator lever 120 can be interlocked with the connecting member 113 being ascended/descended regardless of the position of the auxiliary frame body 90. Therefore, the indicator end 120*b* of the sheet remaining amount indicator lever 120 can accurately indicate the sheet remaining amount. Still further, because the sheet remaining amount indicator lever 120 moves approximately in the horizontal and vertical directions, it is not necessary to consider a move of the sheet remaining amount indicator lever 120 in the width direction W of the sheet S. This arrangement makes it possible to increase the indicating range of the sheet remaining amount indicator 100, i.e., the height of the indicator window 91, without increasing the size of the apparatus body 10 while having the sheet cassette 31 extendable corresponding to a sheet size.

Still further, according to the sheet cassette 31 of the present embodiment, the connecting member 113 is directly moved by the fan gear 135, i.e., the lift portion, so that a number of components may be cut as compared to the case of holding the connecting member 113 by utilizing the link member different from the lift portion.

<Third Embodiment>

A third embodiment of the present invention will be described with reference to FIGS. 8A and 8B. A configuration of the present embodiment is different from that of the first embodiment in that the sheet remaining amount detecting portion 110 includes a support mechanism 140 and a transmission member (transmission portion) 141. The configurations of the both embodiments are the same other than that, so that the same or corresponding components will be denoted by the same reference numerals and their description will be omitted here.

Figure 8A:
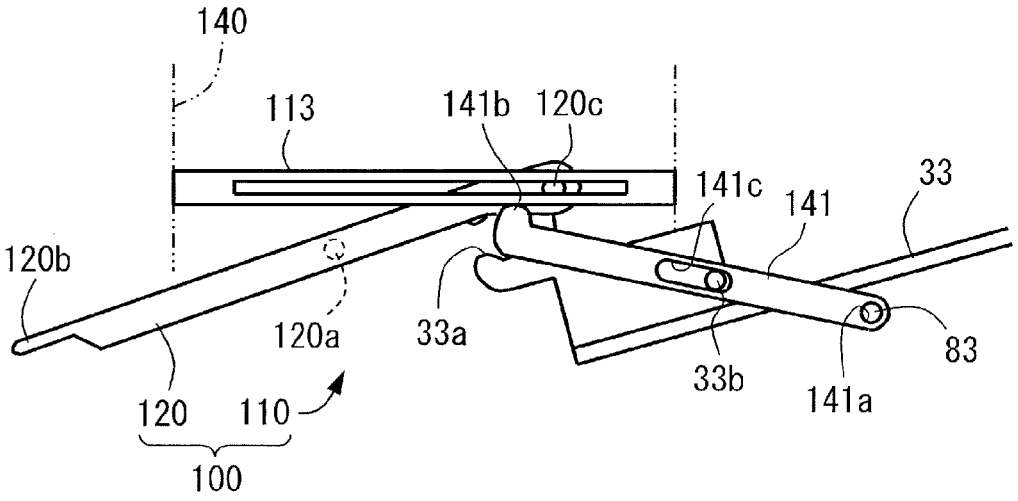
FIG. 8A is a side view schematically illustrating a sheet remaining amount indicator of a sheet cassette of an image forming apparatus of a third embodiment in a state in which there are a few sheets.
Figure 8B:
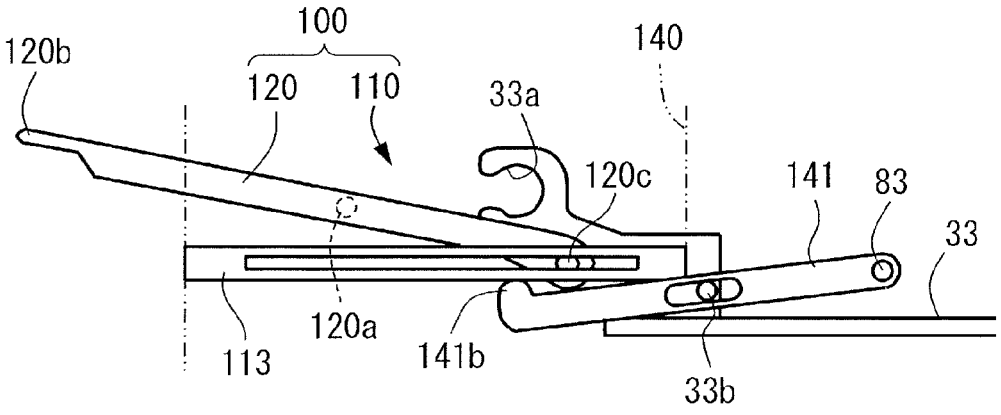
FIG. 8B is a side view schematically illustrating the sheet remaining amount indicator of the sheet cassette of the image forming apparatus of the third embodiment in a state in which there are many sheets.

As illustrated in FIGS. 8A and 8B, the sheet remaining amount detecting portion 110 of the present embodiment includes the support mechanism 140 and the transmission member 141. The support mechanism 140 supports the connecting member 113 ascendably/descendably while keeping its horizontal state. An existing or a new adequate mechanism such as a link mechanism, a slide mechanism, a pulley mechanism, or the like maybe applied for the support mechanism 140.

The transmission member 141 includes a support hole 141*a* provided at a base end part, an abutting portion 141*b* formed at a front end part, and an engaged hole 141*c* provided approximately at a center part of the transmission member 141. The transmission member 141 is supported turnably by the shaft 83 provided on the main frame body 80 through the support hole 141*a*. The abutting portion 141*b* is abuttable with a bottom surface of the connecting member 113. The engaged hole 141*c* is formed along a longitudinal direction of the transmission member 141 and engages slidably with the shaft 33*b* projecting in the width direction W from the sheet stacking plate 33. Thereby, the transmission member 141 is connected turnably with the sheet stacking plate 33, supports the connecting member 113 from underneath, and elevates the connecting member 113 in response to the elevation of the sheet stacking plate 33. It is noted that when the abutting portion 141*b* of the transmission member 141 comes down, the connecting member 113 comes down by its own weight.

According to the sheet cassette 31 of the present embodiment, the sheet stacking plate 33 turns centering on the turning center 33*a* as the driving source not illustrated is driven when the sheet cassette 31 storing the sheet S in the state in which the auxiliary frame body 90 is inserted is attached to the apparatus body 10. In the same time when the sheet stacking plate 33 rises, the connecting member 113 is moved through the transmission member 141. Then, the connecting member 113 moves along a vertical surface containing the front-back and vertical directions while approximately keeping its horizontal state.

Accordingly, the connecting member 113 ascends/descends in response to the ascendance and descendance move of the sheet stacking plate 33 and the engage portion 120*c* of the sheet remaining amount indicator lever 120 can be interlocked with the connecting member 113 being ascended/descended regardless of the position of the auxiliary frame body 90 also in the sheet cassette 31 of the present embodiment. Due to that, the indicator end 120*b* of the sheet remaining amount indicator lever 120 can accurately indicate the sheet remaining amount. Still further, because the sheet remaining amount indicator lever 120 moves approximately in the horizontal and vertical directions, it is not necessary to consider a move of the sheet remaining amount indicator lever 120 in the width direction W of the sheet S. This arrangement makes it possible to enlarge the indicating range of the sheet remaining amount indicator 100, i.e., the height of the indicator window 91, without increasing the size of the apparatus body 10 while having the sheet cassette 31 extendable corresponding to a sheet size.

Still further, according to the sheet cassette 31 of the present embodiment, the elevation mechanism of the connecting member 113 can be simplified further. It is noted that the elevation mechanism of the connecting member 113 is not limited to the transmission member 141 and may be configured such that the connecting member 113 is directly pushed up by the sheet stacking plate 33 for example.

<Fourth Embodiment>

Next, a fourth embodiment of the present invention will be described with reference to FIG. 9. A configuration of the present embodiment is different from that of the first embodiment in that the sheet remaining amount detecting portion 110 includes a push-up member (push-up portion) 150 and an incline portion 151. The configurations of the both embodiments are the same other than that, so that the same or corresponding components will be denoted by the same reference numerals and their description will be omitted here.

Figure 9:
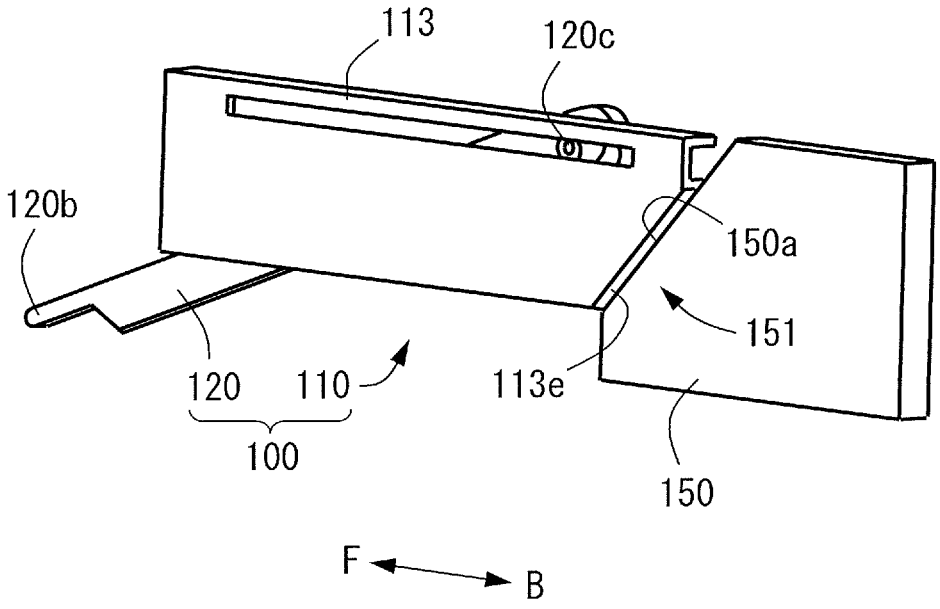
FIG. 9 is a perspective view schematically illustrating a sheet remaining amount indicator of a sheet cassette of an image forming apparatus of a fourth embodiment.

As illustrated in FIG. 9, the sheet remaining amount detecting portion 110 of the present embodiment includes the push-up member 150 provided on the main frame body 80 and the incline portion 151 provided at a part where the connecting member 113 contacts with the push-up member 150. The push-up member 150 is provided to be movable in the draw and insert directions of the auxiliary frame body 90 and to be immovably in the downward direction. That is, the push-up member 150 moves in the draw and insert directions of the auxiliary frame body 90 in response to the ascendance and descendance move of the sheet stacking plate 33. According to the present embodiment, the push-up member 150 moves in the front direction F in a case where the sheet stacking plate 33 rises and in the back direction B in a case where the sheet stacking plate 33 comes down.

The incline portion 151 includes an inclined surface 150*a* formed along an edge of the push-up member 150 and an inclined surface 113*e* formed along an edge of the connecting member 113. The inclined surface 150*a* of the incline portion 151 and the inclined surface 113*e* are inclined such that the push-up member 150 pushes up the connecting member 113 when the push-up member 150 moves toward the connecting member 113.

According to the sheet cassette 31 of the present embodiment, the sheet stacking plate 33 rises as the driving source not illustrated is driven when the sheet cassette 31 storing the sheet S in the state in which the auxiliary frame body 90 is inserted is attached to the apparatus body 10. In the same time, the push-up member 150 moves in the front direction F and moves the connecting member 113 along a vertical surface containing the front-back and vertical directions while keeping its approximate horizontal state through the incline portion 151.

Accordingly, the connecting member 113 ascends/descends in response to the ascendance and descendance move of the sheet stacking plate 33, and the engage portion 120*c* of the sheet remaining amount indicator lever 120 can be interlocked with the connecting member 113 being ascended/descended regardless of the position of the auxiliary frame body 90 also in the sheet cassette 31 of the present embodiment. Due to that, the indicator end 120*b* of the sheet remaining amount indicator lever 120 can accurately indicate the sheet remaining amount. Still further, because the sheet remaining amount indicator lever 120 moves approximately in the horizontal and vertical directions, it is not necessary to consider a move of the sheet remaining amount indicator lever 120 in the width direction W of the sheet S. This arrangement makes it possible to increase the indicating range of the sheet remaining amount indicator 100, i.e., the height of the indicator window 91, without increasing the size of the apparatus body 10 while having the sheet cassette 31 extendable corresponding to a sheet size.

Still further, the sheet cassette 31 of the present embodiment permits the elevation mechanism of the connecting member 113 to be simplified further.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133226, filed Jul. 2, 2015, which is hereby incorporated by reference herein in its entirety.

What is claimed is:

1. A sheet supporting device, comprising:

a supporting unit comprising a first supporting unit and a second supporting unit provided to the first supporting unit and drawable in a draw direction from an insert position, the supporting unit configured to extend its size, corresponding to a size of a sheet to be supported, by moving the second supporting unit with respect to the first supporting unit in the draw direction;

a supporting portion on which sheets are supported and provided ascendably/descendably in the first supporting unit;

first and second turning portions configured to turn in linkage with an ascendance and descendance movement of the supporting portion;

an elevation portion whose one end is connected with the first turning portion and another end is connected with the second turning portion, the elevation portion being configured to form a link mechanism together with the first and second turning portions and the first supporting unit; and an indicator provided in the second supporting unit and indicating an amount of the sheets supported on the supporting portion by moving in response to an ascendance and descendance movement of the elevation portion.

2. The sheet supporting device according to claim 1, wherein the elevation portion ascends/descends while keeping in parallel with the draw direction.

3. The sheet supporting device according to claim 1, wherein the indicator comprises an engage portion, the elevation portion comprises an engaged portion engaged by the engage portion, and the indicator is movable in the draw direction with respect to the elevation portion by the engage portion guided by the engaged portion and movable in a vertical direction together with the elevation portion.

4. The sheet supporting device according to claim 3, wherein the engage portion moves along the engaged portion in the draw direction in a case where the second supporting unit is drawn from the first supporting unit.

5. The sheet supporting device according to claim 4, wherein either one of the engage portion and the engaged portion comprises a concave portion and the other one of the engage portion and the engaged portion comprises a convex portion engaging with the concave portion.

6. The sheet supporting device according to claim 5, wherein the indicator comprises a lever, a rotation shaft configured to support the lever turnably on the second supporting unit, and an indicator end provided at an end of the lever and exposed in the draw direction of the second supporting unit, the indicator end ascending/descending by a turn centering on the rotation shaft in response to an ascendance and descendance movement of the engage portion and indicating the amount of the sheets supported on the supporting portion.

7. The sheet supporting device according to claim 1, wherein the supporting portion ascends/descends while turning.

8. The sheet supporting device according to claim 1, further comprising a lift portion configured to lift the supporting portion and move the elevation portion through the supporting portion.

9. The sheet supporting device according to claim 1, wherein the second supporting unit comprises an indicator window exposing the indicator on a front side in the draw direction.

10. The sheet supporting device according to claim 9, wherein the indicator comprises a lever moving in response to the ascendance and descendance movement of the elevation portion, and an indicator piece exposed through the indicator window and lifted by the lever along the indicator window.

11. The sheet supporting device according to claim 1, wherein the indicator comprises a crank portion bent into a shape of a crank.

12. The sheet supporting device according to claim 1, wherein the elevation portion, the first and second turning portions, and the first supporting unit compose a parallel link mechanism.

13. The sheet supporting device according to claim 12, wherein the first turning portion is configured to be turned by the ascendance and descendance movement of the elevation portion.

14. The sheet supporting device according to claim 12, wherein the first turning portion comprises a lift portion configured to lift the supporting portion.

15. The sheet supporting device according to claim 14, wherein the lift portion comprises a fan gear configured to lift the supporting portion by turning.

16. The sheet supporting device according to claim 1, wherein the indicator comprises an engage portion engaging with the elevating portion, and the engage portion is guided by the elevation portion and moves along the elevation portion in a case where the second supporting unit moves in/out of the first supporting unit in the draw directions.

17. A sheet supporting device, comprising:

a first supporting unit;

a second supporting unit provided to the first supporting unit and drawable in a draw direction from an insert position;

a supporting portion on which a sheet is supported and provided ascendably/descendably in the first supporting unit;

an indicator provided in the second supporting unit and indicating an amount of the sheets supported on the supporting portion; and a moving portion provided in the first supporting unit, and comprising an elevation portion being kept in parallel with the draw direction, the elevation portion being configured to move in a vertical direction in parallel with the draw direction in response to an ascendance and descendance movement of the supporting portion, wherein the indicator is movable in response to a move of the moving portion in a case where the second supporting unit is provided in the insert position and in a case where the second supporting unit is drawn from the first supporting unit.

18. The sheet supporting device according to claim 17, wherein the moving portion comprises:

a support mechanism configured to ascendably/descendably support the elevation portion; and a transmission portion turnably connected to the first supporting unit, supporting the elevation portion from underneath, and ascending/descending the elevation portion in response to the ascendance and descendance movement of the supporting portion.

19. The sheet supporting device according to claim 17, wherein the moving portion comprises:

a push-up portion provided in the first supporting unit to be movable in the draw direction and an insert direction of the second supporting unit and to be restricted from moving in a downward direction, the push-up portion moving in the draw and insert directions of the second supporting unit in response to the ascendance and descendance movement of the supporting portion; and an incline portion provided at least at one of the elevation portion and the push-up portion and inclined in a direction in which the push-up portion pushes up the elevation portion in a case where the push-up portion moves toward the elevation portion.

* * * * *